US007850239B1

(12) United States Patent
Still

(10) Patent No.: US 7,850,239 B1
(45) Date of Patent: Dec. 14, 2010

(54) CHAIR WITH SPRING ACTUATED REAR LEGS TO MINIMIZE MUSCLE STRAIN

(76) Inventor: Harry Still, 35 Victoria St., Georgetown, ON (CA) L7G 3N5

( * ) Notice: Subject to any disclaimer, the term of this patent is extended or adjusted under 35 U.S.C. 154(b) by 167 days.

(21) Appl. No.: 12/171,224

(22) Filed: Jul. 10, 2008

(51) Int. Cl.
*A47C 1/00* (2006.01)

(52) U.S. Cl. ..... 297/325; 297/DIG. 10; 297/271.5

(58) Field of Classification Search ..... 297/325, 297/271.5, 258.1, DIG. 10
See application file for complete search history.

(56) References Cited

U.S. PATENT DOCUMENTS

| | | | | | |
|---|---|---|---|---|---|
| 77,161 | A * | 4/1868 | Blake | 248/188.9 |
| 1,291,150 | A * | 1/1919 | Robinson | 297/293 |
| 1,922,418 | A * | 8/1933 | Conant | 297/344.18 |
| 3,183,861 | A * | 5/1965 | Halstrick | 297/311 |
| 3,455,605 | A * | 7/1969 | Anderson | 297/446.2 |
| 4,688,851 | A * | 8/1987 | Whiteford | 297/313 |
| 4,762,365 | A * | 8/1988 | Grossfield | 297/325 |
| 5,054,852 | A * | 10/1991 | Tholkes | 297/172 |
| 5,203,610 | A * | 4/1993 | Miller | 297/344.16 |
| 5,490,715 | A * | 2/1996 | Opsvik | 297/310 |
| 5,516,197 | A | 5/1996 | Condos | |
| 6,056,353 | A * | 5/2000 | Meara | 297/41 |
| 6,871,911 | B2 * | 3/2005 | Alexander, Jr. | 297/344.18 |
| 7,073,860 | B2 * | 7/2006 | Markus | 297/316 |

* cited by examiner

*Primary Examiner*—David Dunn
*Assistant Examiner*—Erika Garrett
(74) *Attorney, Agent, or Firm*—Crossley Patent Law; Mark A. Crossley

(57) ABSTRACT

A chair to minimize muscle strain as a person sits in or rises providing an identical pair of elongated parallelepiped back frames having a vertically extending upper portion, a rearwardly extending lower portion with a parallelepiped connection member extending perpendicularly therebetween to connect the back frames. A parallelepiped crossbar extends between a pair of front legs. A spring assembly having a parallelepiped upper mount member, a parallelepiped lower mount member, and a single coil spring therebetween is secured to the lower edge of the back frame lower portion. The selective placement of a user's weight upon the seat positions the spring into either a compressed state, wherein the seat is parallel to a floor surface, or an uncompressed state, wherein the seat is at an angle to the floor surface.

10 Claims, 3 Drawing Sheets

CHAIR WITH SPRING ACTUATED REAR LEGS TO MINIMIZE MUSCLE STRAIN

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

FIELD OF THE INVENTION

The present invention relates to chairs and, more specifically, to a chair having spring-actuated rear legs to tilt the chair's seat either forwardly or downwardly in order to minimize a person's muscle strain as the person sits down or rises from the chair.

BACKGROUND OF THE INVENTION

Many chairs having adjustable legs are provided in prior art. One patent teaches a lightweight, portable adjustable folding chair that accommodates persons with joint disabilities. Another patent provides an adjustable chair having telescopic legs which have a flexible compression member within a hollow sleeve on the legs which are connected to a strut at one end and to an adjustment means at the other end. Still another patent provides a vehicle seat with spring biased mounting units. Even another patent teaches adjustable table legs providing extensible legs each having an elongated tubular section having a threaded opening therein; an elongated tubular sleeve slidably mounted on the section and having a longitudinally extending slot therein, the slot being laterally offset at spaced intervals therealong; a screw shiftably threaded in the opening and extending through the slot for sliding movement therein; and a spring interconnecting the section and the sleeve for biasing the sleeve toward the uppermost end of its path of travel. Yet another patent teaches a lift chair with a base, a seat, and an extensible and retractable power-actuated ram connected between the lift base and seat to selectively raise and lower the seat. What is needed, however, is a chair actuated by a spring to raise and lower the chair seat via a coil spring leg assembly which minimizes stress as a person sits down or raises from the chair without the use of external power or the need to manually adjust any moving parts for operation.

SUMMARY OF THE INVENTION

The present chair minimizes muscle strain as a person sits in or rises from the chair without the use of external power or the need to manually adjust any moving parts for operation. The chair has pair of back frames, each with a vertically extending upper portion and a rearwardly extending lower portion having a lower edge. A parallelepiped connection member extends perpendicularly between and connects the back frames. A pair of parallel front legs is provided, each having an upper end, a lower end, a rear edge, a front edge, an inside edge, and an outside edge. A crossbar extends between and connects the front leg inside edges and is parallel to the connection member. A pair of seat base members is provided, each having a top edge, a first edge perpendicularly affixed to and extending forwardly from a back frame, and an opposite second edge affixed to a front leg rear edge. A connecting member, having an upper edge, is affixed to and extends between the seat base members and is further affixed to each of the back frames lower portion. A seat, having a top portion parallel to the crossbar, is affixed to each of the back frames at a juncture of the upper portion and lower portion, to the top edge of each seat base member, the upper end of each front leg, and the upper edge of the connecting member.

The chair also provides a spring assembly having a parallelepiped upper mount member and a parallelepiped lower mount member. The upper mount member has a front side and a top side, which is affixed to the lower edge of the back frame lower portion. The lower mount member, having the same dimensions as the upper mount member, is positioned parallel to the upper mount member. In addition, the lower mount member has a forward edge and a bottom edge. The spring assembly also provides a securement means, which may be a screw or other fastener, to secure the upper mount member top side to the lower edge of the back frame lower portion. The spring assembly further provides a spring, which has a first end, a second end, and a single coil therebetween. The first end is movably connected to the upper mount member front side and a second end is movably connected to the lower mount member forward edge via the coil. The spring is selectively positioned into a compressed state and an uncompressed state whereby the seat is selectively tilted forwardly and downwardly. The selective placement of a user's weight upon the seat positions the spring into either a compressed state or an uncompressed state. The seat is parallel to a floor surface only when the spring is in the compressed state. The spring supports up to a selected maximum user weight when the spring is in the compressed state. For example, the spring may be constructed to hold a weight of up to three hundred pounds or another selected maximum weight. The chair may be constructed from wood, metal, or durable plastic. The present chair is constructed in a wide variety of colors and with a variety of ornate designs. The chair is reasonably priced The present chair eliminates the need to provide a power source to position a chair seat for easily rising from or sitting down on the seat.

As such, the general purpose of the improved chair which has all of the advantages of the prior art mentioned heretofore and many novel features that result in an improved chair which is not anticipated, rendered obvious, suggested, or even implied by the prior art, either alone or in combination thereof.

An object of the present chair is to provide a seat which selectively tilts either forwardly or downwardly.

Another object of the present chair is to provide a seat which selectively tilts either forwardly or downwardly without the use of a power source to actuate the tiling action.

Yet another object of the present chair is to provide a seat which selectively tilts either forwardly or downwardly without the need for manually adjusting moving parts.

Still another object of the present chair is to allow a person to selectively tilt a chair seat either forwardly or downwardly by either sitting on or rising from the chair seat.

Still yet another object of the present chair is to selectively tilt a chair seat by the selective placement of a user's weight on the chair seat.

Thus has been broadly outlined the more important features of the improved chair so that the detailed description thereof that follows may be better understood and in order that the present contribution to the art may be better appreciated.

These together with additional objects, features and advantages of the improved chair will be readily apparent to those of ordinary skill in the art upon reading the following detailed description of presently preferred, but nonetheless illustrative, embodiments of the improved chair when taken in conjunction with the accompanying drawings. In this respect, before explaining the current embodiments of the improved chair in detail, it is to be understood that the invention is not limited in its application to the details of construction and arrangements of the components set forth in the following description or illustration. The invention is capable of other examples and of being practiced and carried out in various ways. It is also to be understood that the phraseology and terminology employed herein are for purposes of description and should not be regarded as limiting.

Those skilled in the art will appreciate that the concept of this disclosure may be readily utilized as a basis for the design of other structures, methods, and kits for carrying out the several purposes of the improved chair. It is therefore important that the claims be regarded as including such equivalent constructions insofar as they do not depart from the spirit and scope of the present invention.

Objects of the improved chair, along with various novel features that characterize the invention are particularly pointed out in the claims forming a part of this disclosure. For better understanding of the improved chair, its operating advantages and specific objects attained by its uses, refer to the accompanying drawings and description.

DETAILED DESCRIPTION OF THE DRAWINGS

Figure 1:
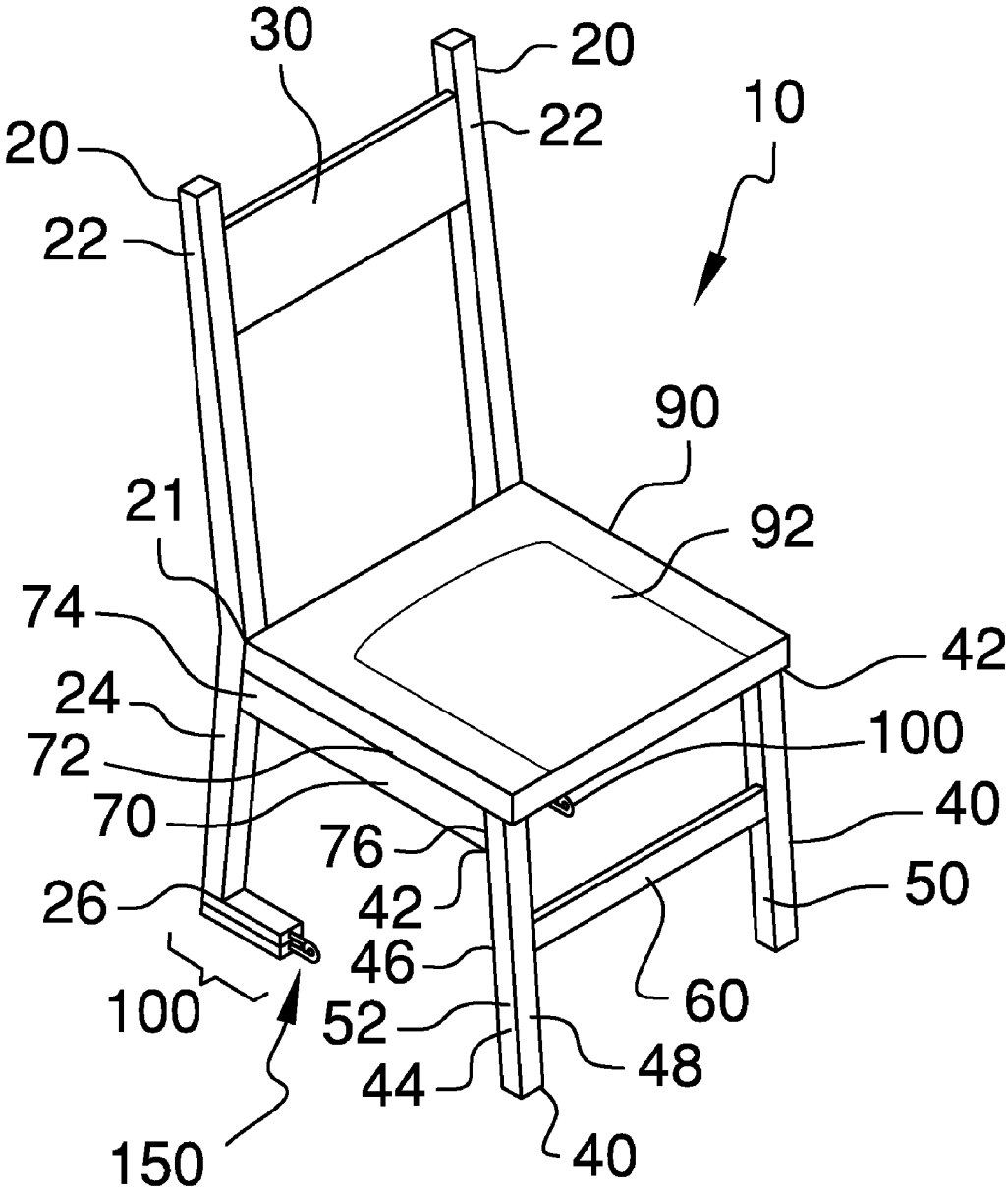
FIG. 1 is a perspective view illustrating a spring in a compressed state.

With reference now to the drawings, and in particular FIGS. 1 through 5 thereof, examples of the employing the principles and concepts of the present chair, generally designated by the reference number 10, will be described.

Referring to FIGS. 1 through 5, the present chair 10 minimizes muscle strain by tilting the seat 90 either forwardly or downwardly as a person sits in or rises from the chair 10. The chair 10 provides an identical pair of elongated parallelepiped back frames 20. Each back frame 20 has a vertically extending upper portion 22 and a rearwardly extending lower portion 24. The lower portion 24 has a lower edge 26. A parallelepiped connection member 30 extends perpendicularly between and connects the back frames 20. An identical pair of parallelepiped front legs 40 are in parallel position to each other. Each front leg 40 has an upper end 42, a lower end 44, a rear edge 46, a front edge 48, an inside edge 50, and an outside edge 52. A parallelepiped crossbar 60 extends between and connects the inside edges 50 of the front legs 40. The crossbar 60 is parallel to the connection member 30. A pair of identical parallelepiped parallel seat base members 70 each have a top edge 72. Each seat base member 70 has a first edge 74 perpendicularly affixed to and extending forwardly from a back frame 20 and an opposite second edge 76 affixed to a front leg 40 rear edge 46. A parallelepiped connecting member 80 has an upper edge 82. The connecting member 80 is affixed to and extends between the seat base members 70 and is further affixed to each of the back frames 20 lower portion 24. A parallelepiped seat 90 is affixed to each of the back frames 20 at a juncture 21 of the upper portion 22 and lower portion 24, to the top edge of each seat base member, the upper end 42 of each front leg 40, and the upper edge 82 of the connecting member 80. The seat 90 has a top portion 92 parallel to the crossbar 60.

Figure 2:
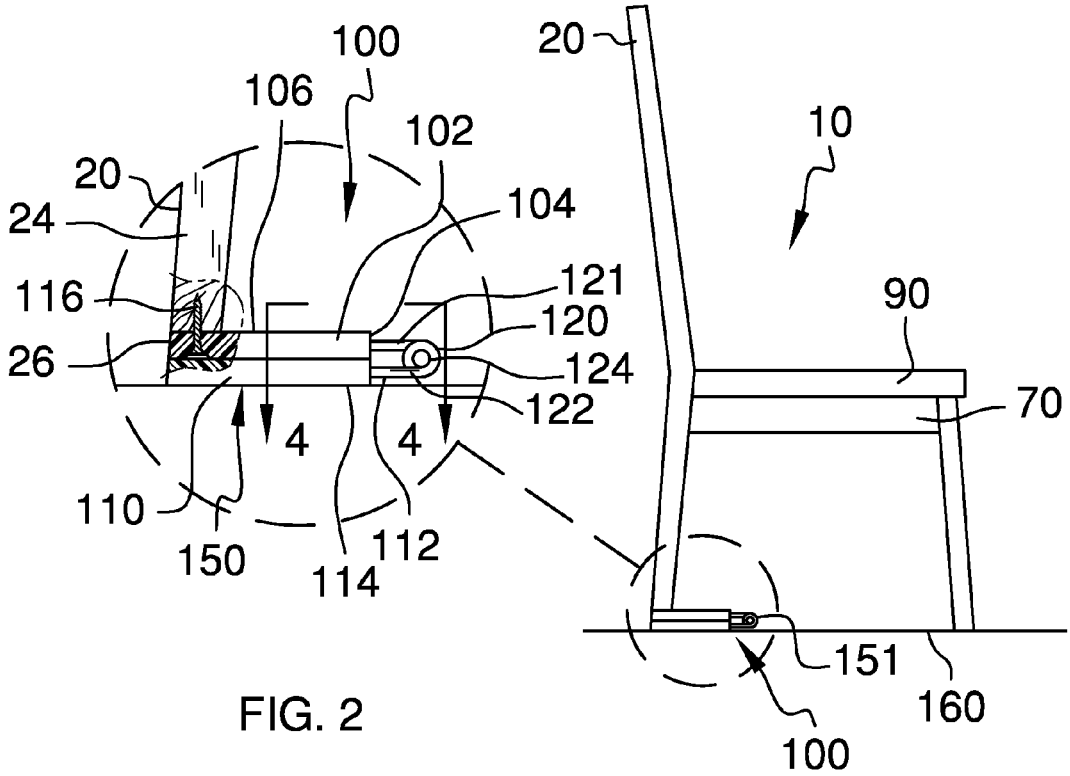
FIG. 2 is a side elevational view illustrating a spring in a compressed state with a detail view of the spring.
Figure 3:
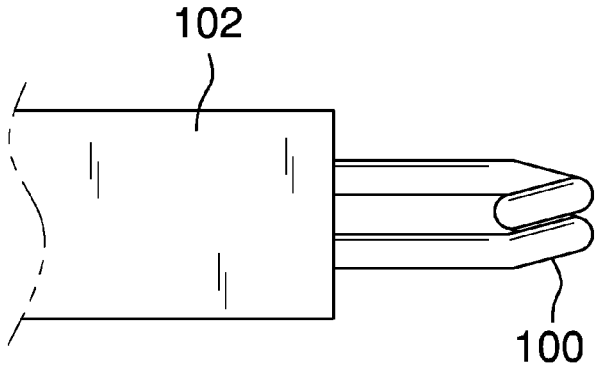
FIG. 3 is a cross-sectional view taken along line 4-4 of FIG. 3.
Figure 4:
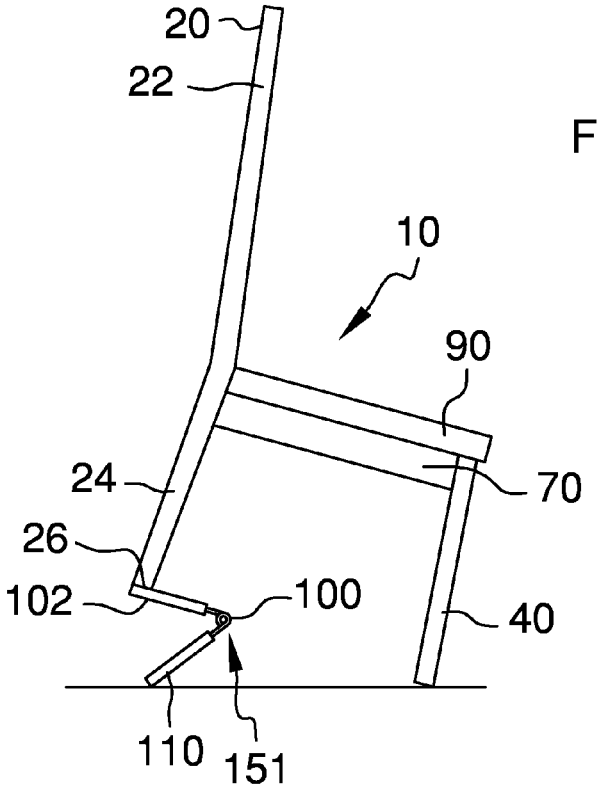
FIG. 4 is a side elevational view illustrating a spring in an uncompressed state.
Figure 5:
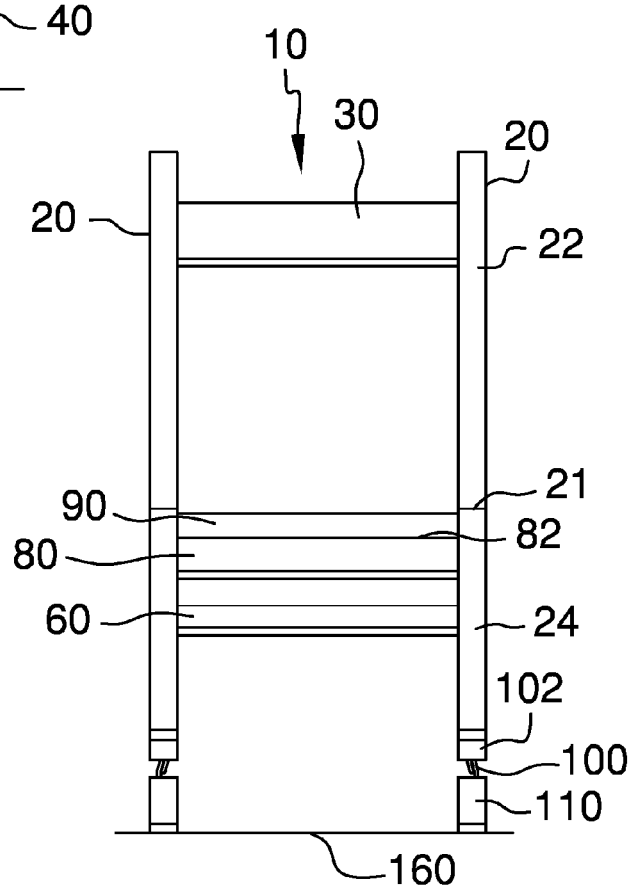
FIG. 5 is a rear elevational view.

The chair 10 also provides a torsion spring assembly 100. The torsion spring assembly 100 has a parallelepiped upper mount member 102 and a parallelepiped lower mount member 110. The upper mount member 102 has a front side 104 and a top side 106. The top side 106 is affixed to the lower edge 26 of the back frame 20 lower portion 24. The lower mount member 110 has the same dimensions as the upper mount member 102. The lower mount member 110 is parallel to the upper mount member 102. In addition, the lower mount member 110 has a forward edge 112 and a bottom edge 114. The torsion spring assembly 100 also provides a securement means 116 to secure the upper mount member 102 top side 106 to the lower edge 26 of the back frame 20 lower portion 24. The securement means 116 may be a screw 117 as shown in FIG. 3 or other similar fastener. The torsion spring assembly 100 further provides a torsion spring 120. The torsion spring 120 has a first end 121, a second end 122, and a single coil 124 therebetween. The first end 121 is movably connected to the upper mount member 102 front side 104 and a second end 122 is movably connected to the lower mount member 110 forward edge 112 via the coil 124. The torsion spring 120 is selectively positioned into a compressed state 150 as illustrated in FIGS. 2 and 3 and an uncompressed state 151 as illustrated in FIGS. 1 and 5 whereby the seat 90 is selectively tilted forwardly and downwardly. The selective placement of a user's weight upon the seat positions the torsion spring 120 into either a compressed state 150 or an uncompressed state 151. The seat 90 is parallel to a floor surface 160 only when the torsion spring 120 is in the compressed state 150, as illustrated in FIG. 3. The torsion spring 90 supports up to a selected maximum user weight when the torsion spring is in the compressed state 150. For example, the torsion spring 90 may be constructed to hold a weight of up to three hundred pounds or another selected maximum weight. The chair 10 may be constructed from wood, metal, or durable plastic.

With respect to the above description then, it is to be realized that the optimum dimensional relationships for the parts of the chair, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Directional terms such as "front", "back", "in", "out", "downward", "upper", "lower", and the like may have been used in the description. These terms are applicable to the examples shown and described in conjunction with the drawings. These terms are merely used for the purpose of description in connection with the drawings and do not necessarily apply to the position in which the present invention may be used.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A chair comprising:

an identical pair of elongated parallelepiped back frames, each back frame having a vertically extending upper portion and a rearwardly extending lower portion, the lower portion having a lower edge;

a parallelepiped connection member extending perpendicularly between and connecting the back frames;

an identical pair of parallelepiped front legs in parallel position to each other, each front leg having an upper end, a lower end, a rear edge, a front edge, an inside edge, and an outside edge;

a parallelepiped crossbar extending between and connecting the inside edges of the front legs, wherein the crossbar is parallel to the connection member;

a pair of identical parallelepiped parallel seat base members having a top edge, each seat base member having a first edge perpendicularly affixed to and extending forwardly from a back frame and an opposite second edge affixed to a front leg rear edge;

a parallelepiped connecting member having an upper edge, the connecting member affixed to and extending between the seat base members and further affixed to each of the back frames lower portion;

a parallelepiped seat affixed to each of the back frames at a juncture of the upper portion and lower portion, to the top edge of each seat base member, the upper end of each front leg, and the upper edge of the connecting member, the seat having a top portion parallel to the crossbar;

a torsion spring assembly comprising:

a parallelepiped upper mount member having a front side and a top side affixed to the lower edge of the back frame lower portion;

a parallelepiped lower mount member having the same dimensions as and parallel to the upper mount member, the lower mount member having a forward edge and a bottom edge;

a securement means to secure the upper mount member to the lower edge of the back frame lower portion;

a torsion spring having a first end, a second end, and a single coil therebetween, wherein the first end is movably connected to the upper mount member front side and a second end is movably connected to the lower mount member forward edge via the coil;

wherein the torsion spring is selectively positioned into a compressed state and an uncompressed state whereby the seat is selectively tilted downwardly and forwardly; and further wherein the seat is parallel to a floor surface only when the torsion spring is in the compressed state.

2. The chair of claim 1 wherein the securement means is a screw.

3. The chair of claim 2 wherein the spring supports up to a selected maximum user weight when the spring is in the compressed state.

4. The chair of claim 3 wherein the maximum user weight is three hundred pounds.

5. The chair of claim 2 wherein the seat is selectively raised and lowered by the selective placement of a user's weight upon the seat.

6. The chair of claim 1 wherein the seat is selectively tilted forwardly and downwardly by the selective placement of a user's weight upon the seat.

7. The chair of claim 6 wherein the spring supports up to a selected maximum user weight when the spring is in the compressed state.

8. The chair of claim 7 wherein the maximum user weight is three hundred pounds.

9. The chair of claim 1 wherein the spring supports up to a selected maximum user weight when the spring is in the compressed state.

10. The chair of claim 9 wherein the maximum user weight is three hundred pounds.

* * * * *